US006178593B1

(12) United States Patent
Carlson

(10) Patent No.: US 6,178,593 B1
(45) Date of Patent: Jan. 30, 2001

(54) VERTICAL PIN AUTOMOBILE DOOR HINGE WEAR COMPENSATOR

(76) Inventor: Robert J. Carlson, P.O. Box 1488, Overton, NV (US) 89040

( * ) Notice: Under 35 U.S.C. 154(b), the term of this patent shall be extended for 0 days.

(21) Appl. No.: 09/178,283

(22) Filed: Oct. 23, 1998

(51) Int. Cl.[7] ..... E05F 5/02; E05D 7/04

(52) U.S. Cl. ..... 16/82; 16/235; 16/242; 16/246; 16/386

(58) Field of Search ..... 16/85, 86 R, 86 A, 16/82, DIG. 6, 235, 242, 246, 374, 375, 386; 296/146.11, 207

(56) References Cited

U.S. PATENT DOCUMENTS

| | | | | |
|---|---|---|---|---|
| 2,259,821 | * | 10/1941 | Johnson | 16/374 |
| 2,724,144 | * | 11/1955 | Lohrman | 16/242 |
| 2,948,917 | * | 8/1960 | Campbell et al. | 16/375 |
| 5,421,124 | * | 6/1995 | Zuccaro | 296/207 |
| 5,524,324 | * | 6/1996 | Kunkel | 16/334 |

* cited by examiner

*Primary Examiner*—Chuck Y. Mah

(57) ABSTRACT

A cylindrical cam apparatus attached to the lower hinge of an automobile door; adjusted as such to automatically spread the hinge leaves apart during closing thereof, thus compensating for hinge assembly wear, restoring smooth and complete latching function of vehicle door.

1 Claim, 3 Drawing Sheets

VERTICAL PIN AUTOMOBILE DOOR HINGE WEAR COMPENSATOR

BACKGROUND—Field of Invention

This invention relates to hinges, specifically those vertically pinned where said door leaf height on the latching end is critical to proper latching function e.g. automobile door hinges.

BACKGROUND—Description of Prior Art

Modern automobile assembly line production quotas required time saving methods of construction. One such employed method is the use of removable pin door hinges to quickly remove the doors from a freshly painted automobile shell. Then traveling down separate lines the doors would be equipped with glass, hardware, and trim. The vehicle body is fitted with upholstery, seats and instruments etc. Eventually the completed doors meet again with the respected completed vehicle body, and lifted into place, the hinge pins are re-inserted. Here it is relevant that I insert a sentence found in the description of U.S. Pat. No. 5,577,295 dated November 1996 Papke-Chrysler Corporation which was issued for a three different diameter hinge pin. The new shape aided in re-inserting the pin by reducing the binding while the pin is driven in. Papke writes "a relatively tight fit between the holes and the hinge pin is required to prevent sloppiness in the subsequent opening and closing movements of the door". Herein lies proof that the automobile industry in general is aware of how critical any free play or "sloppiness" at all in door hinge components will adversely affect smooth and safe door operating functions. The problem with this new production method, removable pin hinges, arose when General Motors Corporation back in 1988 began welding on this type of hinge which are literally non-adjustable to compensate for free play. Although an extensive search has been executed, no prior art, as to a device to correct improper door alignment by mechanically spreading the hinge halves exists. An automotive body shop can replace the door side pin bushings incorporated into the design of such welded on hinges, when wear becomes apparent if the door is difficult to open and close. Such bushing renewal would require around $160 and the inconvenience of leaving your vehicle at a body shop for the day. Sometimes this simple, usually there is no guarantee because of wear to other hinge components i.e. the hinge pin and the chassis side pin holes that the pin was driven into. The hinge pin itself is designed with a knurled head to prevent pin rotation in the chassis side holes (no renewable bushings are used here because the pin is stationary) over time through normal use, the knurling wears and this "tight fitted hinge pin" begins to rotate with the door leaf. Once the holes in the chassis portion of this hinge which the hinge pin relates to, become worn or sloppy, most commonly egg shaped, the only way to restore proper door operations is to replace the complete hinge assembly. For the "welded on" versions it becomes expensive, quotes ranged between $350 to $480 and it usually involves leaving your vehicle at a body repair shop for a couple days.

Other methods discovered include removing the door leaf and welding the chassis side pin holes closed and then re-drilling them. Complete with a new set of hinge pins, prices were around $260 granted you do not need a new latch assembly. The only method that did not require removing the door leaf was one body shop that hooked one end of a cable winch to the bottom edge of the door and the other end to the doors strike peg and literally will bend a door up from its sagging position. Because of the weight involved it soon returns to its sagging position. My invention is unique because it remedies door operating problems, due to hinge component wear, at a fraction of the cost without requiring removal of the vehicle door, in about 15 minutes. Aside of end results of other methods described, there is no prior art directly germane to my invention.

OBJECTS AND ADVANTAGES

Accordingly, several objects and advantages of my invention are;

A. To provide consumers with an inexpensive solution to an expensive problem.

B. Economically restores smooth and safe door operating functions.

C. Should eliminate replacing door latch assembly because lift strike plate has worn.

D. To provide a convenient do-it-yourself product that does not require special tools.

Further objects and advantages of my invention will become apparent from a consideration of the drawings and ensuing description.

DESCRIPTION OF THE DRAWINGS —DRAWING FIGURES

In the drawings FIG. 1 and 2 show placement of my invention, FIG. 3 and 4 show the inventions construction. Because of its simplicity an oblique view is not warranted.

REFERENCE NUMERALS IN DRAWINGS

10-Bolt 12-Washer

14-Bushing 16-Cam

18-Star lock washer

DESCRIPTION

FIGS. 1 thru 4

Figure 1:
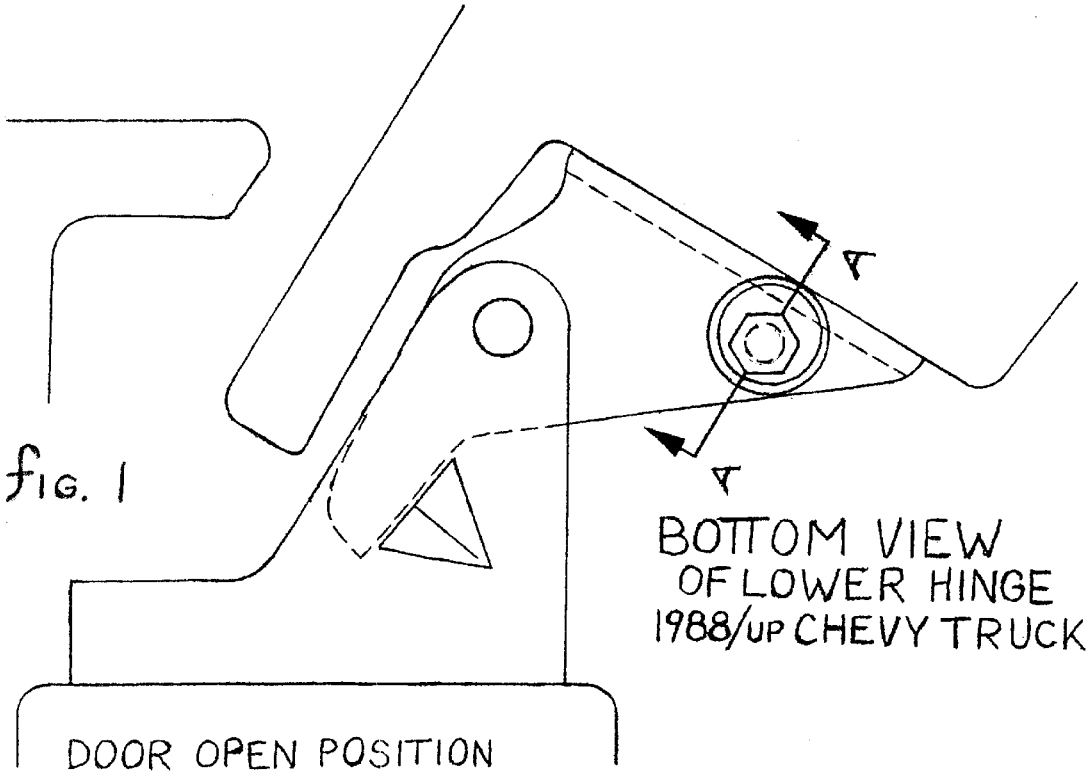
FIG. 1 Shows an actual welded on General Motors hinge assembly, 1988–91 ½ ton truck, in the door fully opened position, with the wear compensating device installed.
Figure 2:
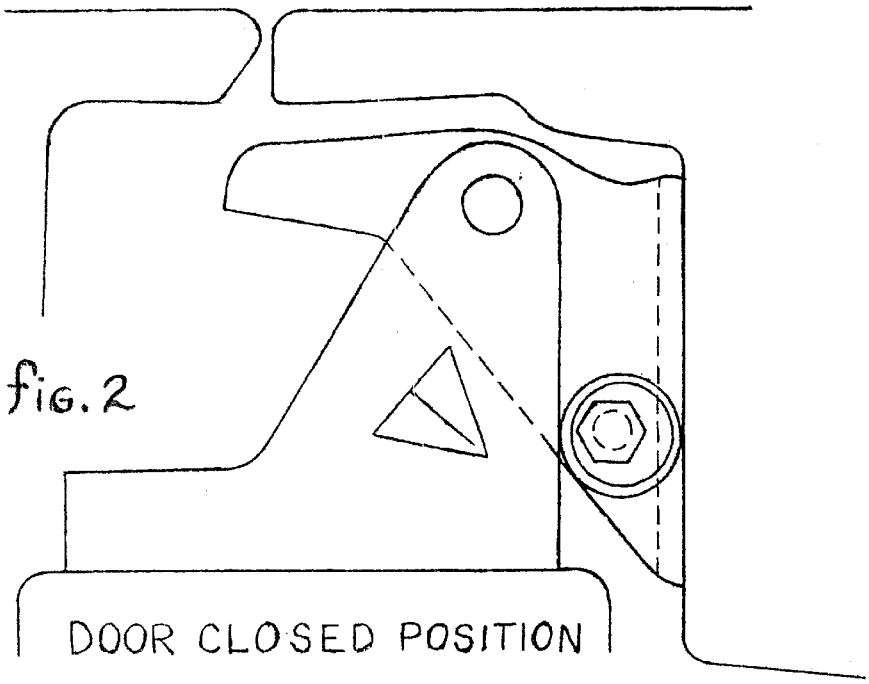
FIG. 2 Shows same hinge assembly in the door completely closed position, with the wear compensating device installed, here the device is activated.

A preferred embodiment of the wear compensating device is shown installed on an actual scaled down General Motors truck hinge assembly of the weld on type with the door opened completely in FIG. 1. Other vehicle applications may require different placement of the wear compensating device and possibly dimensional differences. FIG. 2 illustrates the same door hinge in its completely closed position with the installed wear compensating device in its activating position. Here one can see the limited application space. Because of this limitation the embodiment that utilized a roller bearing instead of a bronze bushing had to be abandoned, however if hinge manufacturers would accommodate by broadening this section a roller type bearing could be used thus improving on this invention.

Figure 3:
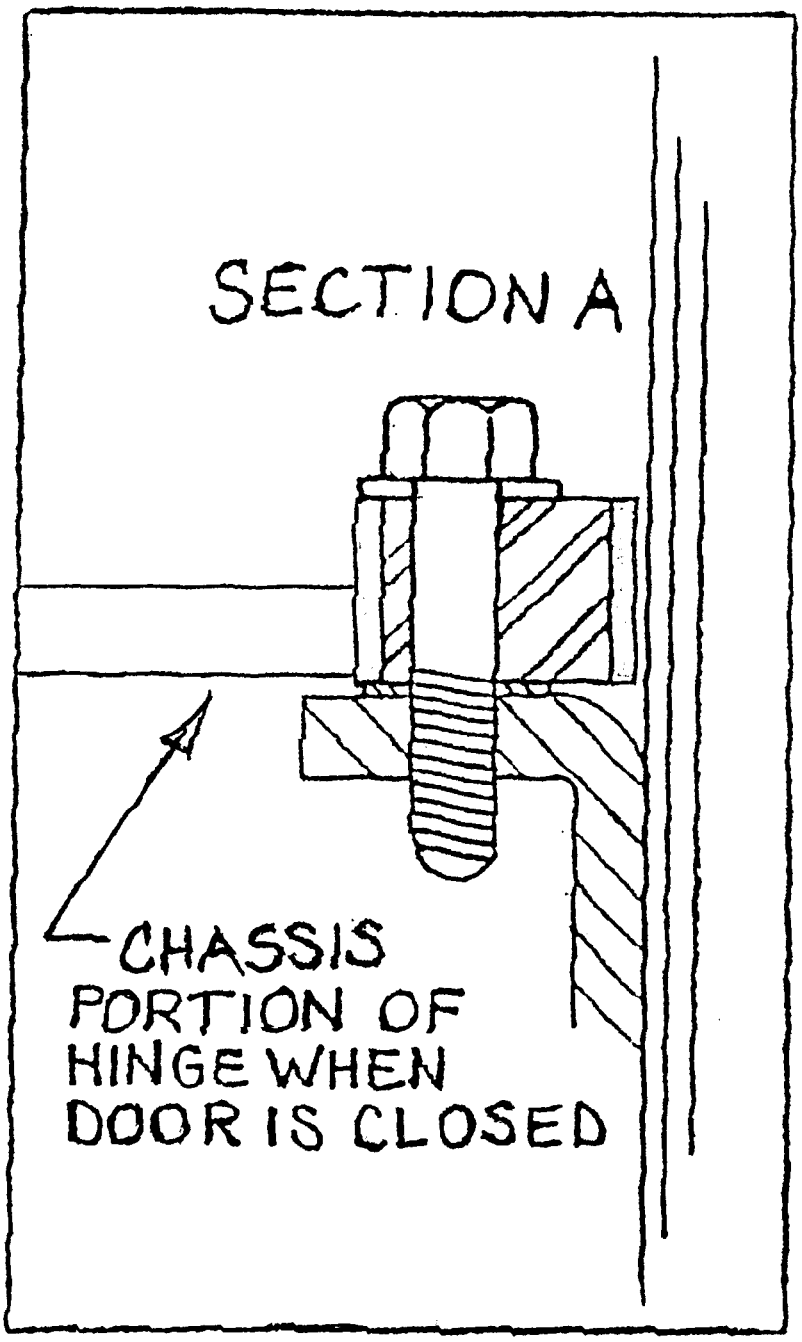
FIG. 3 Shows a cross section of same hinge assembly and installed device.

In FIG. 3 a cross section of the wear compensator device is shown as bolted to the door portion of the hinge assembly.

The other halve of the hinge assembly is drawn in with broken lines for clarity, here one could see the "pinch point" later referred to in operation of invention.

Figure 4:
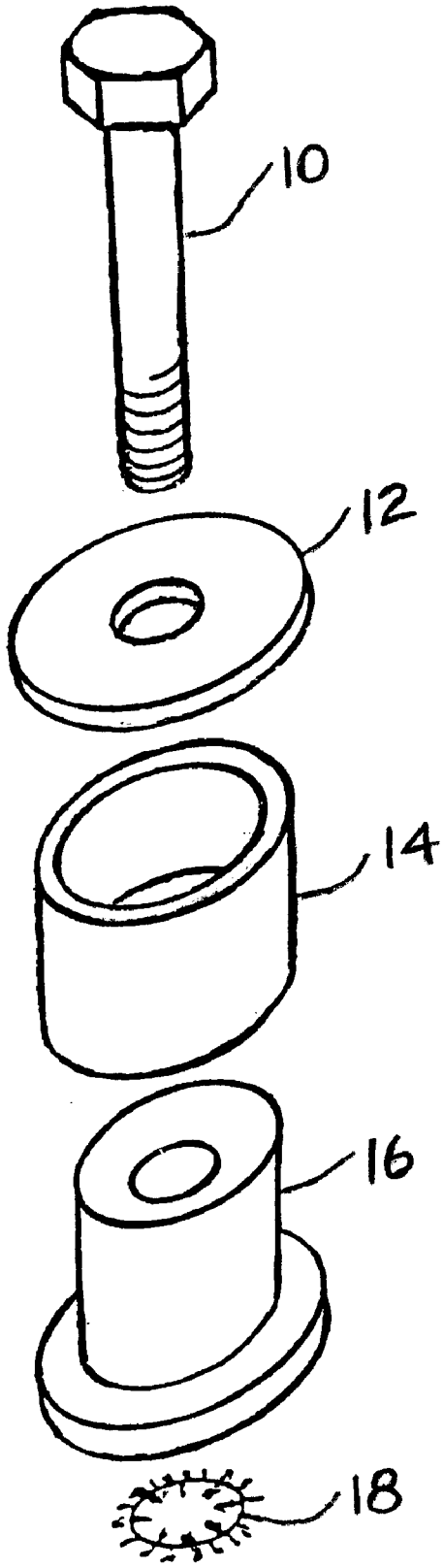
FIG. 4 Shows a cross section of wear compensating device only.

Because of its relatively simple design only a cross section of the wear compensating device as in FIG. 4 shall be submitted. In this drawing one could see the cam (16) which would be referred to as the guts of this invention. The cam (16) is cut from a ½" diameter piece of cold rolled steel bar stock. A ¼" diameter hole is drilled through the length at 1/16" off center in both directions thus enabling the cam to be adjusted for either the severity of door hinge component wear and or installation inaccuracy. Over this 9/16" long cam (16) is a ½" long bronze bushing (14) with an inside diameter dimension of ½". Because the bushing is 1/16" shorter than the cam (16) it will freely rotate around the cam thus preventing a flat spot from forming on the cam (16) through constant use. The star lock washer (18) below the cam will contact the door portion of a vehicle hinge the device has been installed on. This locking function of washer (18) will prevent the cam (16) from rotating once it has been properly set. The device bolt (10) is hardened to prevent bending from the stress involved in operation. A flat washer (12) is used to assure proper bolt (10) torqueing procedure.

OPERATION OF INVENTION

The wear compensator device works on the theory that the wear of components in a vertically pinned hinge assembly can be compensated for by mechanically spreading the hinge halves apart to their original position before wear occurred. To clarify, as the components in a vertically pinned hinge begin to wear from normal operation the weight of the hinged leaf will cause the bottom hinge halves to contract, the top hinge halves to separate. However slight, this movement will cause the opposite end of the hinged leaf to drop or "sag", adversely affecting the door operation.

The "pinch point" (referred to in FIG. 3, Description of Drawings ) is that segment of the hinge travel when the wear compensating device contacts the chassis halve of the hinge assembly. Further door leaf closing movement beyond this contact will spread the hinge halves apart causing the sagging door leaf to lift. When properly installed and adjusted the wear compensating device causes this described interference in closing just moments before the door is to latch (approx. 5 degrees) thus raising the sagging door up to the proper latch function, restoring smooth and complete door operation.

The embodiment selected for disclosure uses a small adjustable cam (16) wrapped with a free movement bronze bushing (14), bolted (10) in position near the pinch point of a typical vertically pinned automobile door hinge assembly. Other embodiments include, but are not limited to, the use of a roller bearing where the bronze bushing (14) is used. Also considered was a U shaped strap of ¼" by 1" steel bar stock, slipped over the edge of such hinge and clamped in place with set screws. Although simple and inexpensive there is no compensation for device wear.

My wear compensating device as drawn in FIG. 1 and 2, is applied to a welded on 1988–91 General Motors truck door hinge. The device is installed on the top of the doors lowest hinge. The installation placement is established by turning the lowest setting of the device cam (16) toward the opposing hinge halve, commonly the chassis portion. After placing flat, turned as such, on the top side of the door portion of the lowest hinge the cam (16) is backed up against the hinged door leaf and the hole for the bolt (10) is marked. After drilling and tapping hole for bolt (10) the wear compensating device is bolted in place with the lowest cam (16) setting facing toward the chassis hinge halve. The door closing and latching operation is now tried. Should no change occur in the doors operating performance the device bolt (10) is loosened and the cam (16) is rotated 10 degrees clockwise, retighten bolt (10). This procedure is repeated until "like new" door operating results are established. It is important to add that over adjustment of device will put undue strain on the hinge assembly, the wear compensating device and possibly the vehicle door leaf resulting in damage to each so proper adjustment is crucial.

SUMMARY

Ramifications and Scope

Thus the reader will see that the wear compensating device of this invention provides a highly reliable, readjustable (compensates for future wear) and economical product that could be installed by consumers themselves without requiring any special tools. Furthermore, the wear compensating device has additional advantages in that;

When installed it is hidden from view, virtually unnoticeable.

Could be engineered to contract top hinge when excessive wear of hinges is present.

While my above description contains many specificities, these should not be construed as limitations on the scope of the invention, but rather an exemplification of one preferred embodiment thereof. Many other variations are possible. For example the wear compensating "theory" could be utilized with redesigned hinge leaves that would enmesh during closing producing desired results. Also a heavy spring incorporated into the design of a hinge assembly could also compensate for hinge component wear. Thus the scope of this invention should be determined by the appended claims and their legal equivalents, rather than by the examples given.

What is claimed is:

1. A hinge wear compensator for an automobile door hinge, comprising: a bushing having two ends, a bore extending between said ends; a cam body having an off-center hole drilled therethrough, said cam body being secured within the bore of said bushing thereby forming a cam device having two ends; a lock washer attached to one end of said cam device and a flat washer attached to the other end of the cam device, and a bolt extending through said flat washer, said off-center hole and said lock washer, and wherein said compensator is adapted to be attached to a door-side hinge portion, during closing movement said compensator contacts a chassis-side hinge portion thereby causing the hinge portions to move in opposite directions to prevent sagging.

* * * * *